US010823437B2

(12) United States Patent
Lee et al.

(10) Patent No.: US 10,823,437 B2
(45) Date of Patent: Nov. 3, 2020

(54) AIR CONDITIONER CAPABLE OF CONTROLLING COOLING AND HUMIDITY, AND CONTROL METHOD THEREFOR

(71) Applicant: KYUNGDONG NAVIEN CO., LTD., Pyeongtaek-si (KR)

(72) Inventors: Dong Keun Lee, Seoul (KR); Won Jae Jin, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 125 days.

(21) Appl. No.: 15/776,672

(22) PCT Filed: Nov. 15, 2016

(86) PCT No.: PCT/KR2016/013147
§ 371 (c)(1),
(2) Date: May 16, 2018

(87) PCT Pub. No.: WO2017/086680
PCT Pub. Date: May 26, 2017

(65) Prior Publication Data

US 2018/0320911 A1 Nov. 8, 2018

(30) Foreign Application Priority Data

Nov. 18, 2015 (KR) ..... 10-2015-0162000

(51) Int. Cl.
*F24F 3/14* (2006.01)
*F24F 3/153* (2006.01)
*F24F 5/00* (2006.01)

(52) U.S. Cl.
CPC ..... *F24F 3/1423* (2013.01); *F24F 3/153* (2013.01); *F24F 5/0014* (2013.01); *F24F 2203/1024* (2013.01); *F24F 2203/1032* (2013.01)

(58) Field of Classification Search
CPC ..... F24F 3/1423; F24F 3/153; F24F 5/0014; F24F 2203/1024; F24F 2203/1032; F24F 11/02; F24F 3/14; F24F 13/04
See application file for complete search history.

(56) References Cited

U.S. PATENT DOCUMENTS

2010/0212345 A1* 8/2010 Yoon ..... F24F 3/1423 62/271
2010/0242507 A1* 9/2010 Meckler ..... F24F 3/1423 62/94
2013/0248147 A1* 9/2013 Wintemute ..... F28F 27/02 165/96

FOREIGN PATENT DOCUMENTS

JP 4639485 B2 2/2011
KR 10-0600773 B1 7/2006
(Continued)

*Primary Examiner* — Elizabeth J Martin
(74) *Attorney, Agent, or Firm* — Stein IP, LLC

(57) ABSTRACT

Provided are an air conditioner capable of indoor cooling and humidity control with a simple structure. The air conditioner comprises: a first air flow channel; a second air flow channel; a dehumidifying rotor which comprises a first region provided on the first air flow channel, a second region provided on the second air flow channel, and an adsorbent which alternately passes through the first region and the second region and adsorbs moisture in the first region or the second region; a cooling unit configured to cool air from which moisture is removed while passing through the first region; and a control unit configured to control the dehumidifying rotor and the cooling unit such that air flowing in the first air flow path is dehumidified and cooled and a temperature or humidity of the indoor area is detected to be adjusted to a set value.

23 Claims, 9 Drawing Sheets

(56) References Cited

FOREIGN PATENT DOCUMENTS

| | | | |
|---|---|---|---|
| KR | 10-2009-0121618 | A | 11/2009 |
| KR | 10-2012-0019469 | A | 3/2012 |
| KR | 10-1436613 | B1 | 11/2014 |

* cited by examiner

[FIG 1]

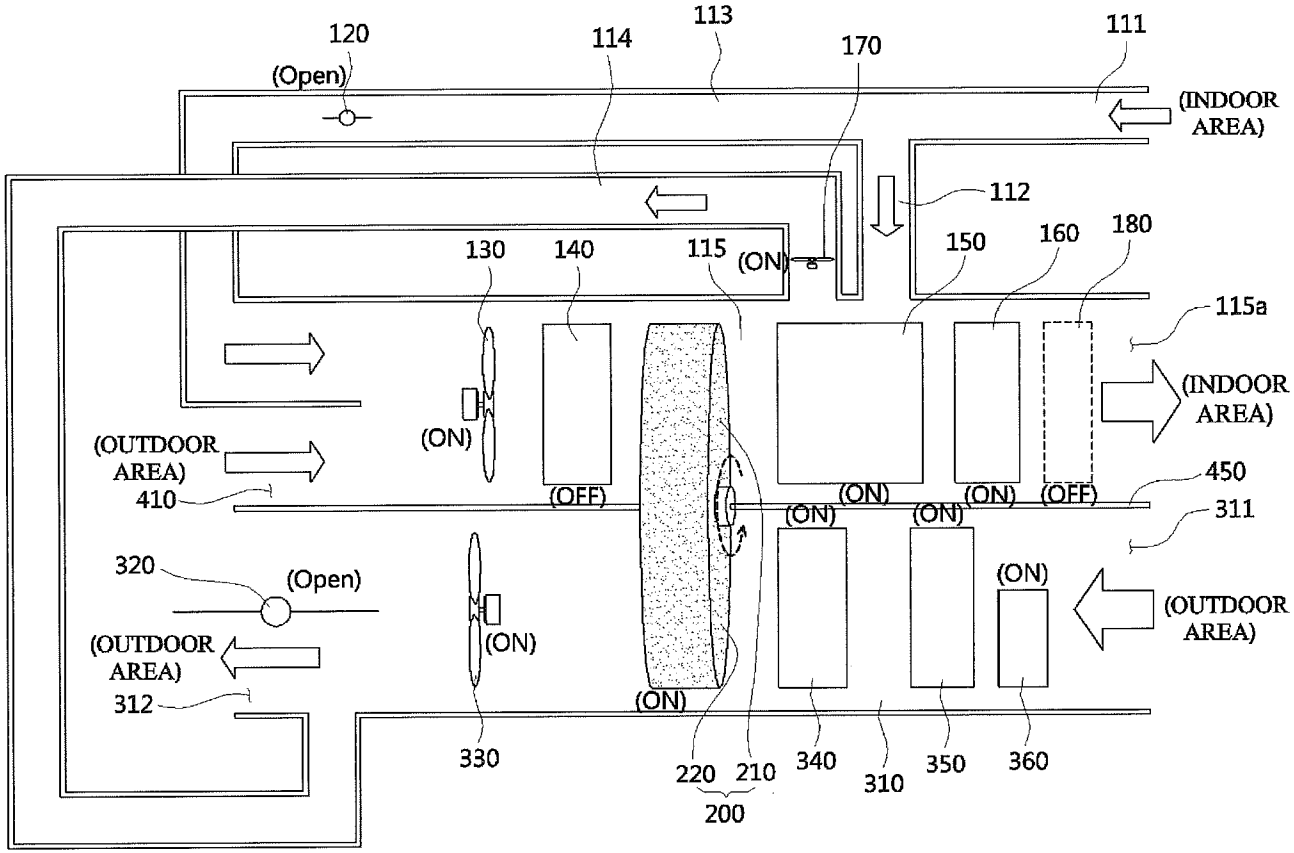
[FIG 3]

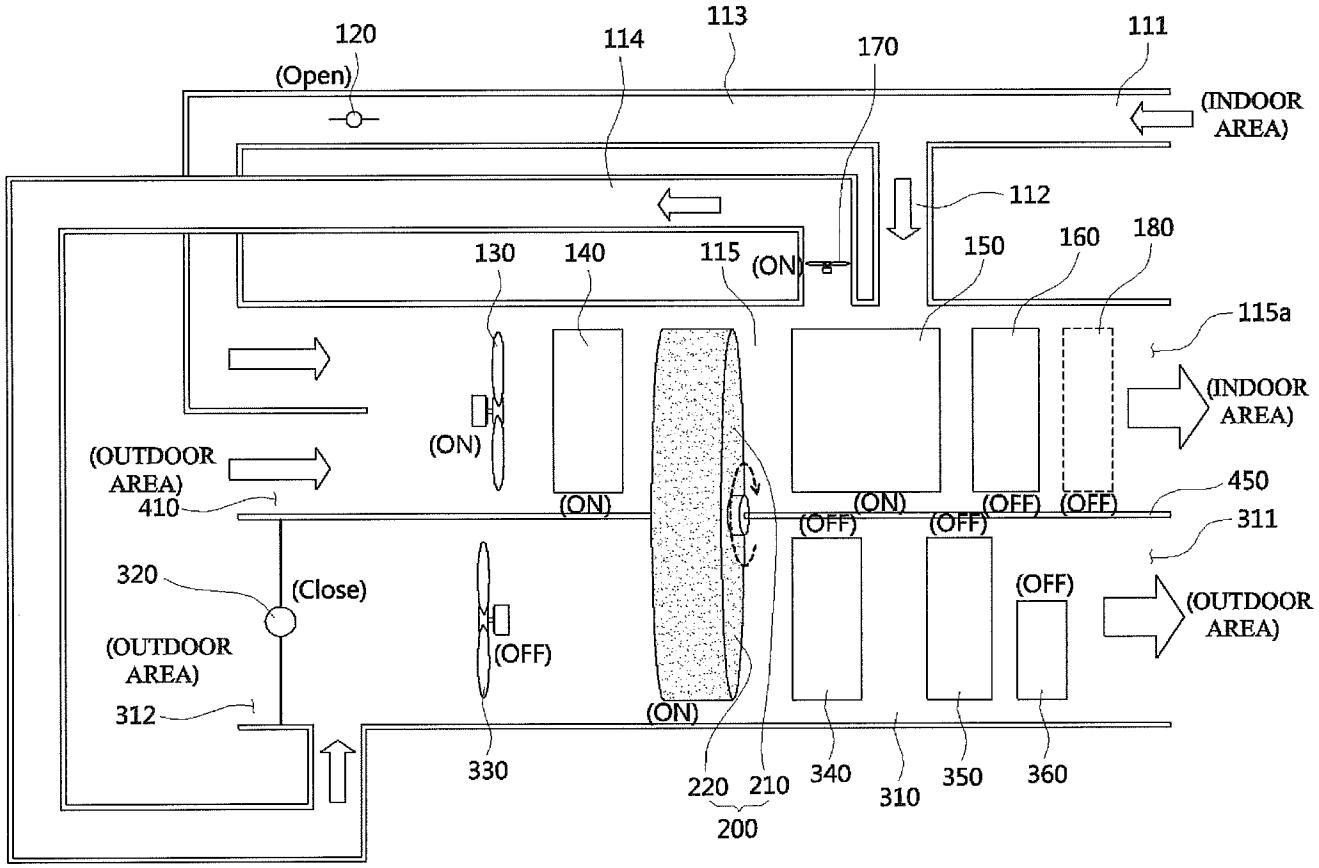
[FIG 4]

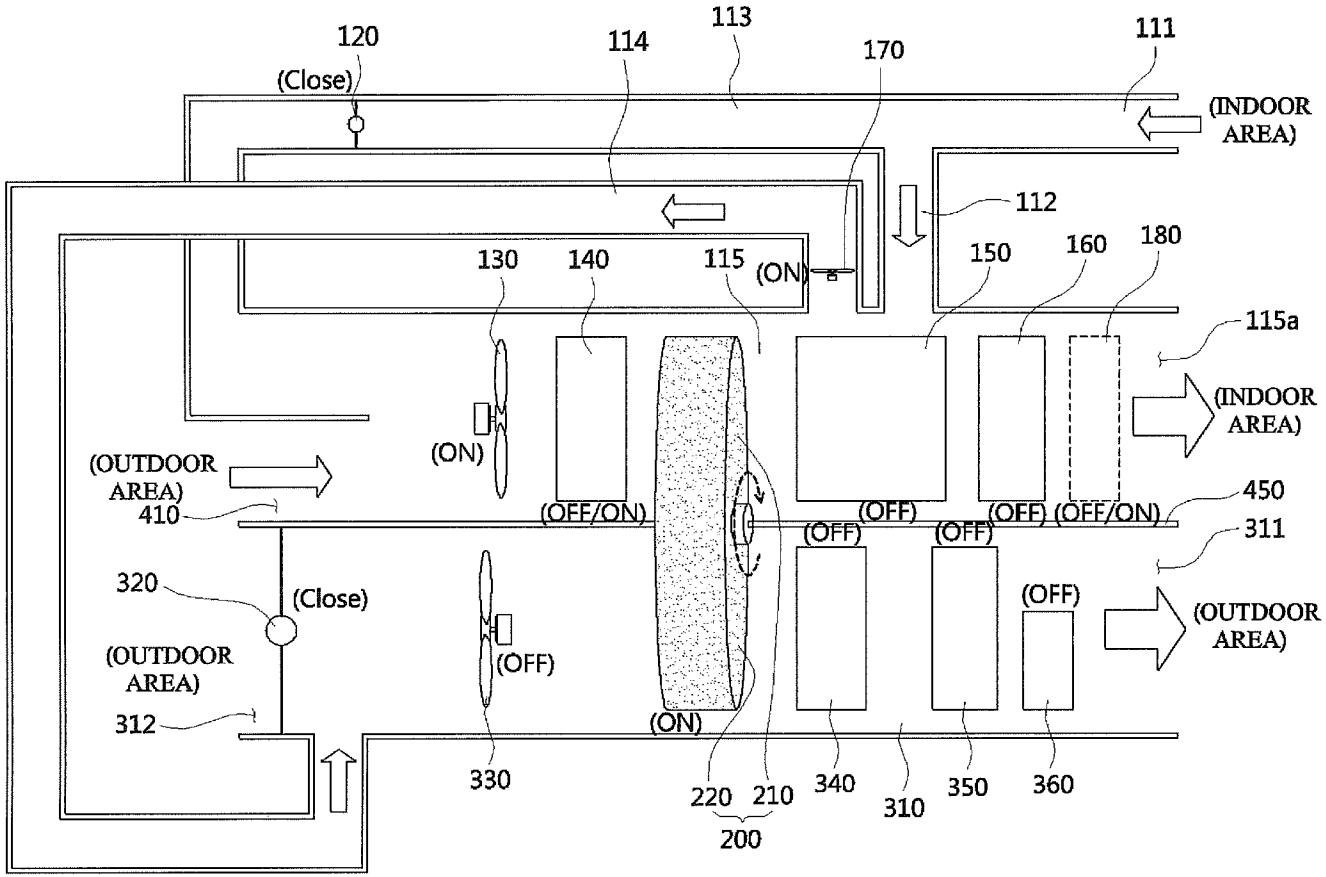
[FIG 5]

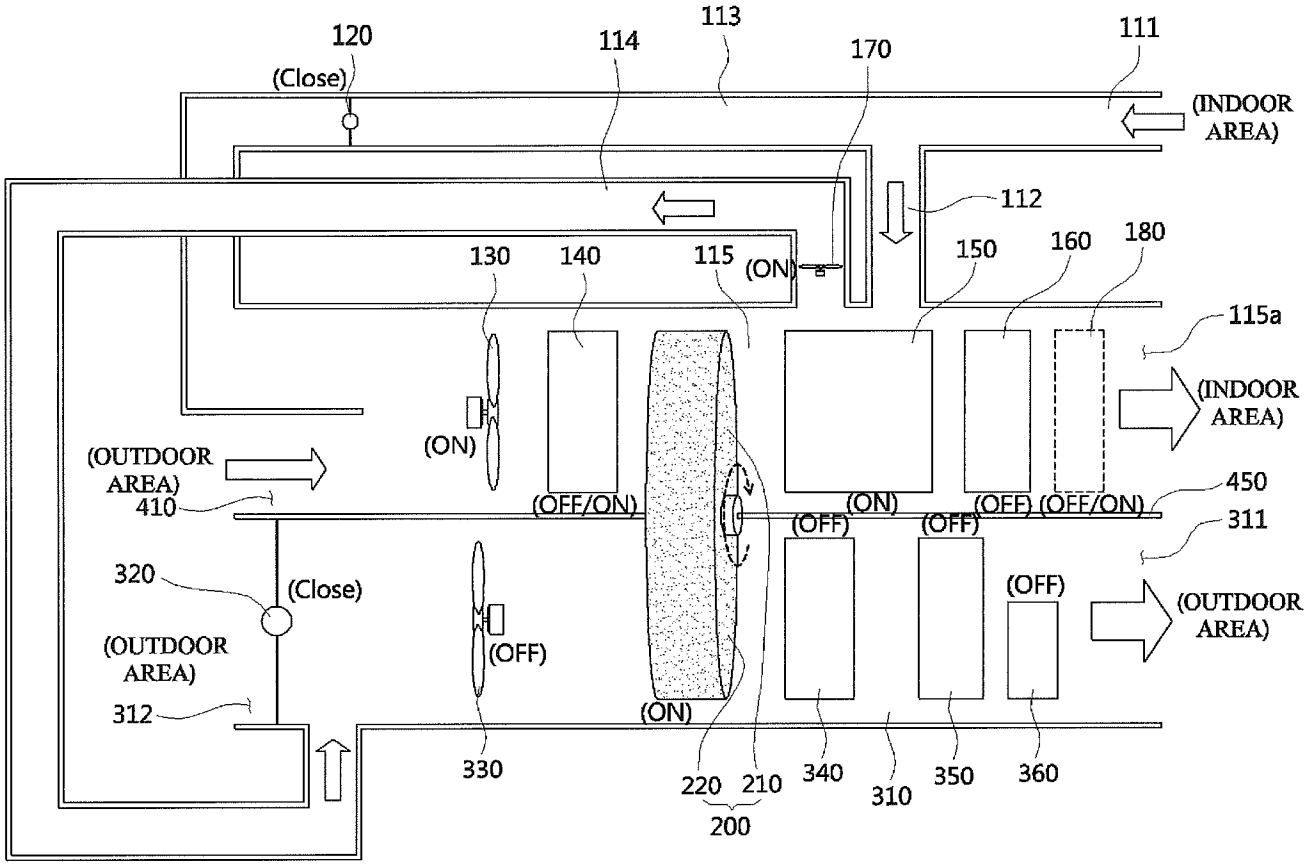
[FIG 6]

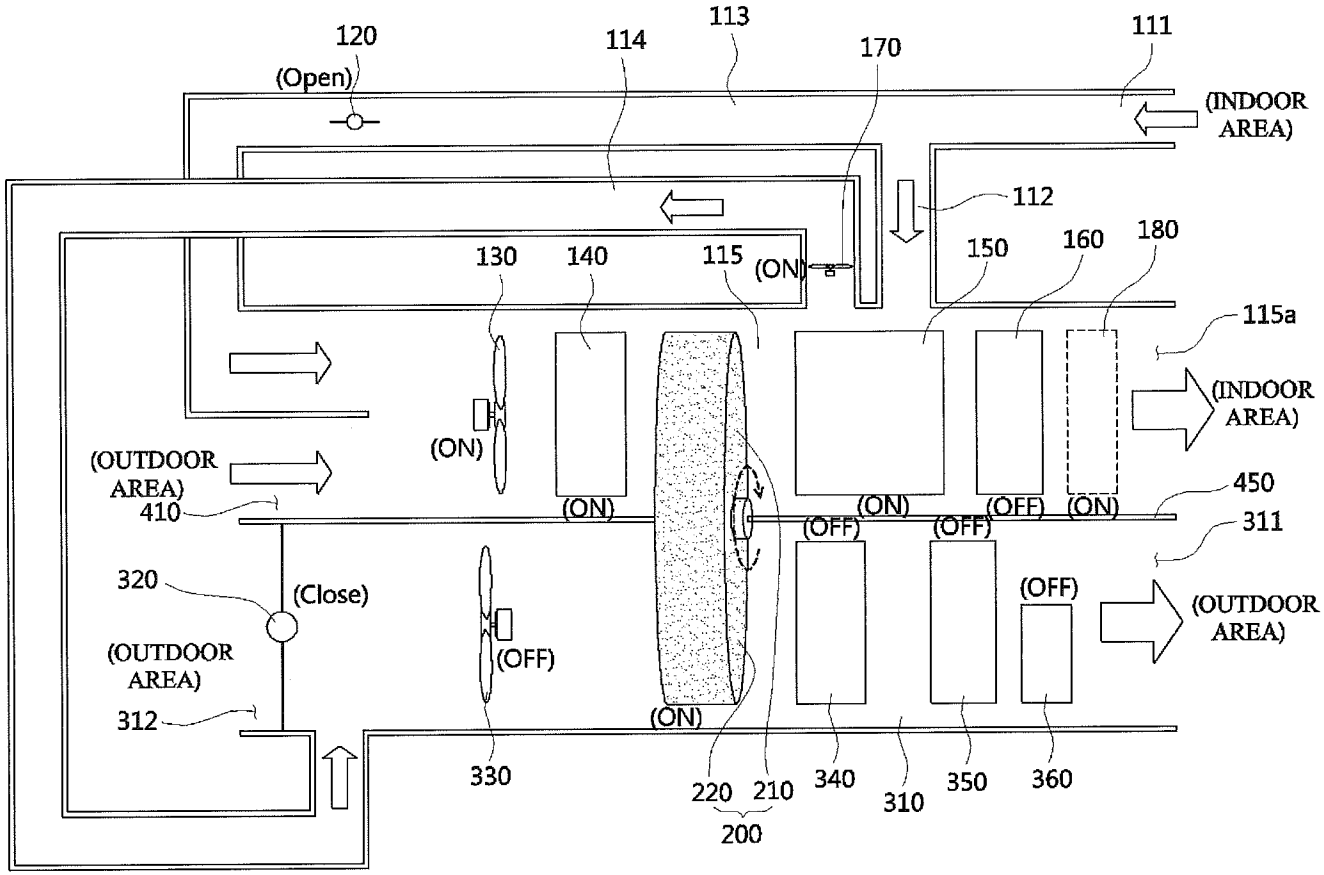
[FIG 7]

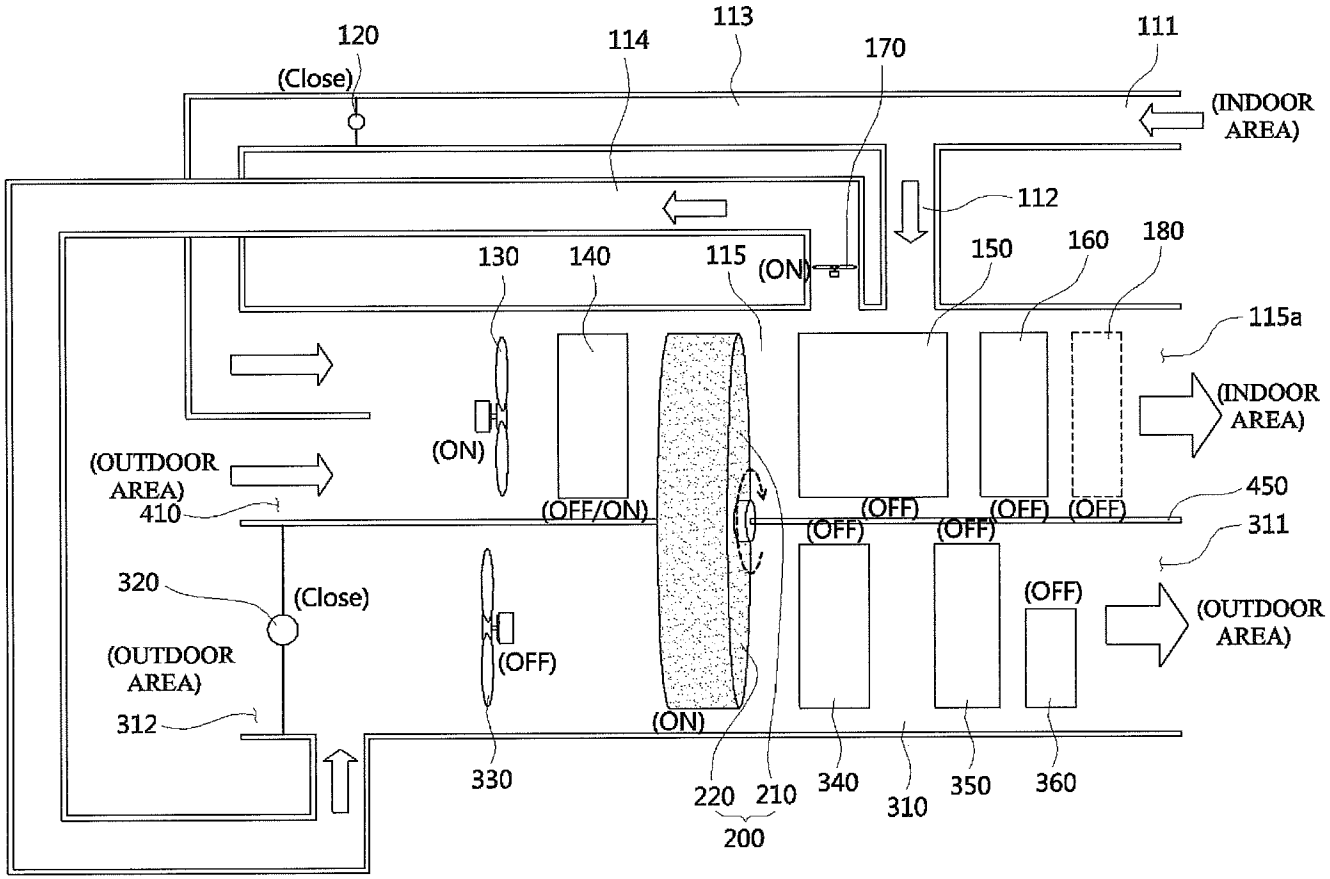
[FIG 8]

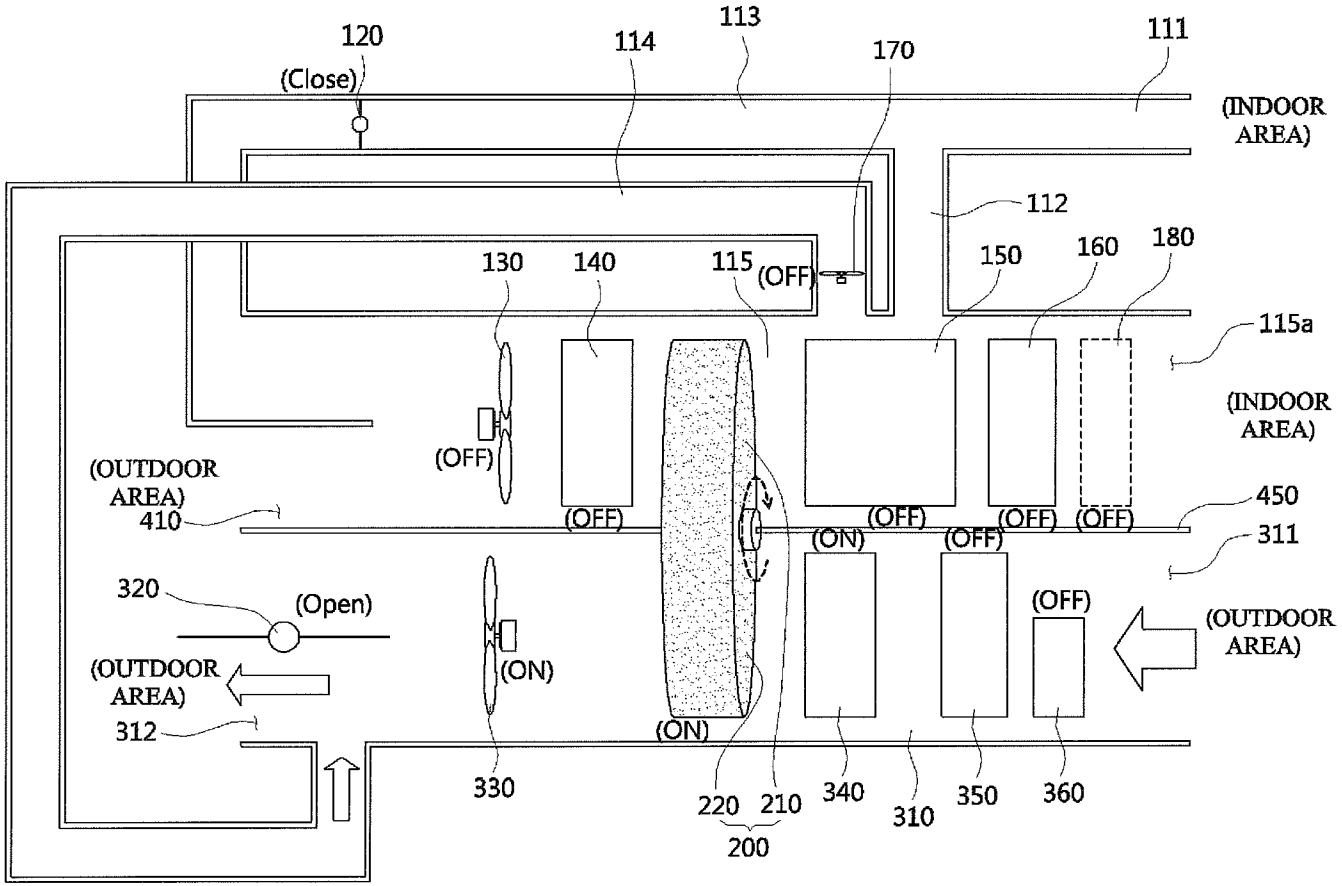
[FIG 9]

AIR CONDITIONER CAPABLE OF CONTROLLING COOLING AND HUMIDITY, AND CONTROL METHOD THEREFOR

CROSS-REFERENCE TO RELATED APPLICATIONS

This application is a national stage of International Application No. PCT/KR2016/013147, filed Nov. 15, 2016, which claims the benefit of priority to Korean Application No. 10-2015-0162000, filed Nov. 18, 2015, in the Korean Intellectual Property Office, the disclosures of which are incorporated herein by reference.

TECHNICAL FIELD

The present invention relates to an air conditioner configured to perform cooling and humidity control, and more specifically, to an air conditioner configured to cool an indoor area and control indoor humidity.

BACKGROUND ART

Generally, an air conditioner is an apparatus configured to perform a cooling or heating cycle by cooling or heating indoor air according to user need.

Recently, technologies in which various functions such as dehumidification, humidification, air purification, and the like are added to an air conditioner to maintain comfortable indoor air according to change in season and user selection have been developed.

Such an air conditioner uses a refrigerant for cooling and dehumidification functions, and is recognized as a primary cause of ozone layer destruction and global warming due to leakage of the refrigerant. In consideration of problems of using such a refrigerant, energy ventilation apparatuses configured to reduce a ventilation load by transmitting sensible and latent heat between indoor air to be discharged and outdoor air to be introduced have been developed.

However, the conventional air conditioner has a collection rate of latent heat significantly lower than that of sensible heat. Therefore, there is a problem in that it is possible for the conventional air conditioner to not correspond to an increase in a cooling load. In consideration of the problems of such an energy air conditioner, a regenerative evaporative cooling technology has been developed.

The regenerative evaporative cooling technology decreases a temperature of air using water evaporation and cooling effects, and since the regenerative evaporative cooling technology does not use a refrigerant except water, problems of the conventional air conditioner may be solved, and thus there is an advantage in that a cooling load may be significantly reduced.

Such an evaporative cooler includes a configuration in which a wet channel and a dry channel are repeatedly formed and which exchanges heat through evaporation in the wet channel and supplies cooled air to an indoor area through the dry channel.

A conventional technology including the evaporative cooler was disclosed in Korean Patent Registration No. 10-1055668 (Core module for regenerative evaporative cooler and method for fabricating the same).

In addition, technologies combined with a cooling cycle technology for cycling a refrigerant have been developed to improve a cooling effect of the conventional evaporative cooler.

One example of such a conventional technology was disclosed in Korean Patent Registration No. 10-0947616 (Air conditioner). Although an air conditioner disclosed in Korean Patent Registration No. 10-0947616 has an advantage in that dehumidification and cooling are performed simultaneously, there is a problem in that indoor air is excessively dry when a dehumidifying and cooling operation is performed for a long time.

In addition, there is a problem in that a structure thereof becomes too complex when cooling, heating, ventilating, and humidity adjusting functions are all included in one air conditioner.

Technical Problem

The present invention is directed to providing an air conditioner capable of indoor cooling and humidity adjustment using a simple structure, and a method of controlling the same.

Technical Solution

To attain the above described object, an air conditioner of the present disclosure comprises a first air flow path (111, 113, 115) provided to communicate with an indoor area; a second air flow path (310) provided to communicate with an outdoor area; a dehumidifying rotor (200) including a first region (210) provided along the first air flow path (111, 113, 115), a second region (220) provided along the second air flow path (310), and an adsorbing material which alternately passes through the first region (210) and the second region (220) according to rotation of the dehumidifying rotor (200) and adsorbs moisture in the first region (210) or the second region (220); a cooling unit (150, 160) configured to cool air from which moisture is removed while passing through the first region (210); and a control unit (10) configured to control the dehumidifying rotor (200) and the cooling unit (150, 160) such that air flowing in the first air flow path (111, 113, 115) is dehumidified and cooled while passing through the first region (210) and the cooling unit (150, 160) and a temperature or humidity of the indoor area is detected to be adjusted to a set value.

A humidification mode may be configured to humidify an indoor area is set in the control unit (10); moisture is supplied to air flowing toward the second region (220) by a moisture supplier (153) when the air conditioner is operated in the humidification mode; and the moisture of the air passing through the second region (220) is moved to the first region (210) according to the rotation of the dehumidifying rotor (200) and evaporated in the first region (210), and humidifies the indoor area.

The first air flow path (111, 113, 115) may include a first inlet flow path (111, 113) configured to connect an inlet through which air in the indoor area is introduced and an inlet end of the first region (210), and a first outlet flow path (115) configured to connect an outlet end of the first region (210) and an outlet through which the air is discharged to the indoor area; an extraction flow path (112, 114) is branched from the first inlet flow path (111, 113) and connected to the second air flow path (310) such that air introduced from the indoor area flows to the second region (220); and the cooling unit (150, 160) includes an evaporative cooler (150) in which heat is exchanged between air flowing in the extraction flow path (112, 114) and air flowing in the first outlet flow path (115).

The evaporative cooler (150) may include a wet channel (151) connected to the extraction flow path (112, 114) and a dry channel 152 connected to the first outlet flow path (115); and a moisture supplier (153) configured to supply moisture to air flowing in the wet channel (151) supplies moisture to the air when the air conditioner is operated in a humidification mode for humidifying the indoor area is operated.

A first heater (140) which is turned on to heat air flowing toward the first region (210) in a case in which the indoor area is humidified may be provided on the first inlet flow path (111, 113).

An extraction blower (170) configured to cause the extracted air to flow is provided on the extraction flow path (112, 114); a first flow path blower (130) configured to introduce air at one side of the indoor area and cause the air to flow to the other side of the indoor area is provided on the first air flow path (111, 113, 115); a second flow path blower (330) configured to introduce air at one side of the outdoor area and cause the air to flow to the other side of the outdoor area is provided on the second air flow path (310); and a direction in which the first flow path blower (130) blows is opposite to a direction in which the second flow path blower (330) blows.

A second damper (320) configured to open or close an outdoor air outlet (312) through which air passing through the second region (220) is discharged to the outdoor area during a humidification mode is provided on the second air flow path (310); and the second damper (320) is opened during a dehumidification mode and closed during the humidification mode such that a direction in which air flows in the second air flow path (310) is reversed between the modes.

A third air flow path (410) through which outdoor air is introduced is connected to the first inlet flow path (113).

A first damper (120) configured to block or release a flow of air introduced from the indoor area is provided in the first inlet flow path (113); the first damper (120) is closed to discharge all of the indoor air introduced through the first inlet flow path (111, 113) to the outdoor area through the extraction flow path (112, 114) and the second air flow path (310); and outdoor air is introduced into the indoor area through the third air flow path (410) to ventilate the indoor air.

A second heater (340), which is turned on to heat air flowing toward the second region (220) to regenerate the second region (220) when the indoor area is dehumidified, may be provided in the second air flow path (310).

The cooling unit (150, 160) includes an evaporator (160) provided on the first air flow path (115) and configured to cool air passing through the first region (210) and supply the air to the indoor area when the indoor area is dehumidified; and a condenser (350), which heats air of the outdoor area flowing toward the second heater (340) when the indoor area is dehumidified, may be provided on the second air flow path (310).

A compressor (360) connected to the evaporator (140) and the condenser (350) and configured to compress a heat transfer medium may be provided on the second air flow path (310) to heat the outdoor air flowing toward the second heater (340) when the indoor area is dehumidified.

The evaporator (160), the condenser (350), and the compressor (360) form a heat pump system to heat air using heat of the evaporator (160) when the indoor area is heated.

A surface of the adsorbing material may be coated with a desiccant polymer.

A method for controlling an air conditioner including a first air flow path (111, 113, 115) provided to communicate with an indoor area, a second air flow path (310) provided to communicate with an outdoor area, and a dehumidifying rotor (200) including a first region (210) provided along the first air flow path (111, 113, 115), a second region (220) provided along the second air flow path (310), an adsorbing material which alternately passes through the first region (210) and the second region (220) according to rotation of the dehumidifying rotor (200) and adsorbs moisture in the first region (210) or the second region (220), and a cooling unit (150, 160) configured to cool air from which moisture is removed while passing through the first region (210), the method comprising: dehumidifying air passing through the first air flow path (111, 113, 115) while the air flows through the first region (210) and regenerating the second region (220) using outdoor air flowing in the second air flow path (310); cooling the air passing through the first region (210) using the cooling unit (150, 160); and controlling, by a control unit (10), the dehumidifying rotor (200) and the cooling unit (150, 160) such that a temperature or humidity of the indoor area is adjusted to a set value thereof.

A second heater (340) may be provided on the second air flow path (310); and the second heater (340) is controlled to be turned on or off according to the indoor humidity.

The number of rotations of the dehumidifying rotor (200) may be changed according to the indoor humidity.

An extraction flow path (112, 114) is branched from the first air flow path (111, 113, 115) and connected to the second air flow path (310) such that extracted air which is some of the air introduced from the indoor area flows to the second region (220); the cooling unit (150, 160) includes an evaporative cooler (150) in which heat is exchanged between air flowing in the extraction flow path (112, 114) and air flowing in the first air flow path (115); and a moisture supplier (153) configured to supply moisture to air flowing in the extraction flow path (112, 114) adjusts an amount of moisture supplied to the air according to the indoor temperature or indoor humidity.

A dehumidification mode or humidification mode is set in the control unit (10), and an air flow direction of the second air flow path (310) during the dehumidification mode is opposite to that of the second air flow path (310) during the humidification mode A second flow path blower (330) configured to cause air to flow is provided in the second air flow path (310); a second damper (320) configured to open or close a flow path is provided at a side from which air is blown by the second flow path blower (330); an extraction flow path (112, 114) is branched from the first air flow path (111, 113, 115) and connected to the second air flow path (310) such that air introduced through the indoor area is caused to flow to the second region (220) by the extraction blower (170); and an air flow direction in the second air flow path (310) is changed by opening or closing the second damper (320) and tuning the second flow path blower (330) and the extraction blower (170) on or off.

A drying mode configured to dry the dehumidifying rotor (200) is set in the control unit (10); when the air conditioner is operated in the drying mode, a blower (170, 330) is operated such that air flows toward the second region (220); and the air passing through the second region (220) is discharged to the outdoor area.

An extraction flow path (114) is branched from the first air flow path (111, 113) and connected to the second air flow path (310); when the air conditioner is operated in the drying mode, an extraction blower (170) provided on the extraction flow path (114) is operated to supply air of the indoor area to the second region (220) such that the air alternately dries an adsorbing material located in the first region (210) and the second region (220) by rotating the dehumidifying rotor (200) and is discharged to the outdoor area; and an amount of outdoor air equal to an amount of the indoor air discharged to the outdoor area is introduced into the indoor area.

A second flow path blower (330) configured to cause air to flow is provided on the second air flow path (310); and when the air conditioner is operated in the drying mode, the second flow path blower (330) is operated to introduce outdoor air from one end of the second air flow path (310) and supply the outdoor air to the second region (220) such that the outdoor air alternately dries an adsorbing material located in the first region (210) and the second region (220) by rotating the dehumidifying rotor (200) and is discharged to the outdoor area through the other end of the second air flow path (310).

Advantageous Effects

According to the present invention, since an indoor temperature and indoor humidity are easily adjusted by controlling a dehumidifying rotor and a cooling unit, a comfortable indoor environment can be maintained.

In addition, since heat exchange between indoor air and outdoor air is performed in the dehumidifying rotor and an evaporative cooler, a cooling or heating load can be reduced.

In addition, since a direction in which outdoor air flows in a second air flow path is changed using a damper, indoor dehumidification, cooling, and humidification can be performed using a simple structure, and thus an indoor temperature and humidity are easily adjusted.

In addition, since a dehumidification and cooling mode, a ventilation mode, and a heating mode are performed in one air conditioner, and a humidifying operation can be performed in each of the modes, an indoor temperature and humidity can be maintained in an optimum state.

In addition, since a heater is provided in a first air flow path in which indoor air flows, an indoor temperature can be quickly increased.

In addition, since a surface of an adsorbing material of the dehumidifying rotor is coated with a desiccant polymer, antibacterial and deodorizing effects can occur while moisture is adsorbed to the adsorbing material.

In addition, since a drying mode is performed to maintain the dehumidifying rotor in a dry state, contamination due to bacterial proliferation can be prevented.

In addition, since indoor air at room temperature flows in the second air flow path during a heating mode, and a room temperature state of a second heater for regenerating a second region of the dehumidifying rotor can be maintained due to the indoor air at room temperature, freezing damage due to water remaining in the second heater can be prevented in the winter season.

DESCRIPTION OF DRAWINGS

FIG. 2 is a view showing a connection structure of the air conditioner illustrated in

FIG. 1.

FIG. 3 is a view showing an operation state during a dehumidifying and cooling operation of the air conditioner according to the present invention.

FIG. 4 is a view showing an operation state during a humidifying operation of the air conditioner according to the present invention.

FIG. 5 is a view showing an operation state during a ventilation mode of the air conditioner according to the present invention.

FIG. 6 is a view showing an operation state of a case in which a humidifying operation is performed in the ventilation mode of the air conditioner according to the present invention.

FIG. 7 is a view showing an operation state of a case in which a humidifying operation is performed in a heating mode of the air conditioner according to the present invention.

FIG. 8 is a view showing an operation state of a case in which a drying mode of a dehumidifying rotor according to one embodiment is performed in the air conditioner according to the present invention.

FIG. 9 is a view showing an operation state of a case in which a drying mode of a dehumidifying motor according to another embodiment is performed in the air conditioner according to the present invention

REFERENCE NUMERALS

111, 113, 115: FIRST AIR FLOW PATH
112, 114: EXTRACTION FLOW PATH
120: FIRST DAMPER
130: FIRST FLOW PATH BLOWER
140: FIRST HEATER
150: EVAPORATIVE COOLER
160: EVAPORATOR
170: EXTRACTION BLOWER
180: THIRD HEATER
200: DEHUMIDIFYING ROTOR
210: FIRST REGION
220: SECOND REGION
310: SECOND AIR FLOW PATH
320: SECOND DAMPER
330: SECOND FLOW PATH BLOWER
340: SECOND HEATER
350: CONDENSER
360: COMPRESSOR
410: THIRD AIR FLOW PATH
450: PARTITION

MODES OF THE INVENTION

Hereinafter, configurations and operations of exemplary embodiments of the present invention will be described in detail with reference to the accompanying drawings.

Figure 1:
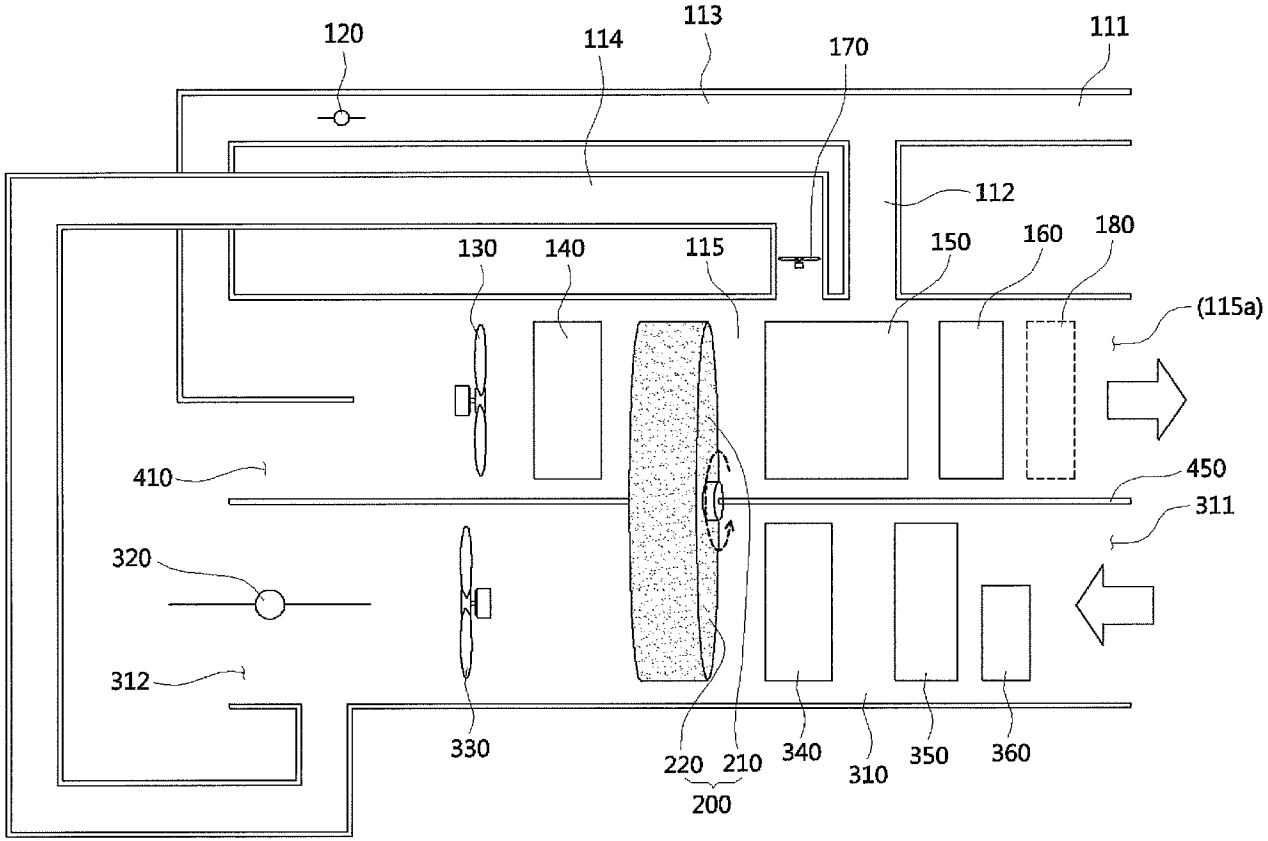
FIG. 1 is a view showing a configuration of an air conditioner according to the present invention.
Figure 2:
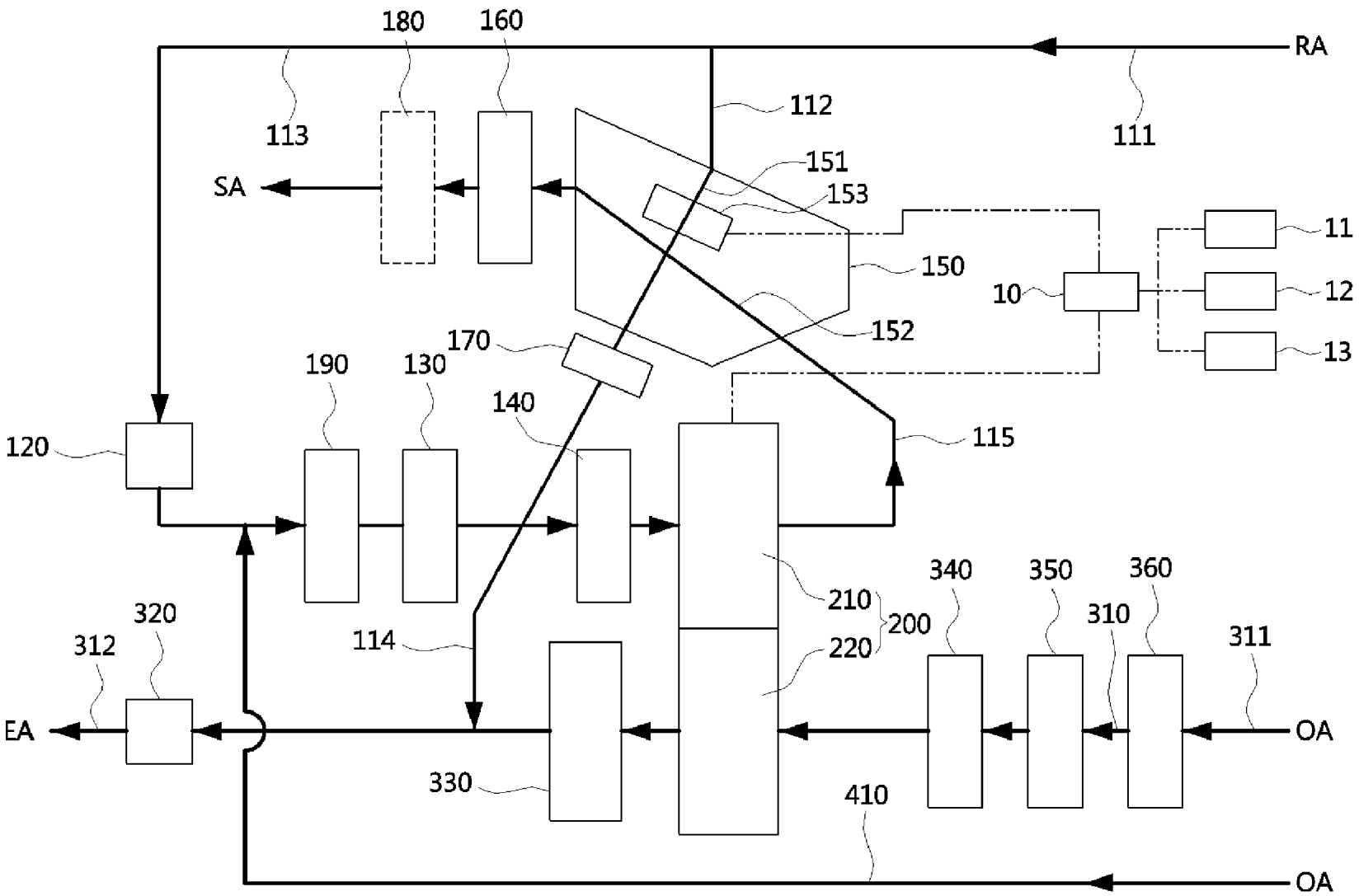

An air conditioner of the present invention will be described with reference to FIGS. 1 and 2.

The air conditioner according to the present invention includes first air flow paths 111, 113, and 115 each having at least one side communicating with an indoor area, a second air flow path 310 having at least one side communicating with the outdoor area, a dehumidifying rotor 200 including a first region 210 provided along the first air flow paths 111, 113, and 115, a second region 220 provided along the second air flow path 310, and an adsorbing material which alternately passes through the first region 210 and the second region 220 according to rotation of the dehumidifying rotor 200 and adsorbs moisture in the first region 210 or the second region 220, cooling units 150 and 160 for cooling air dehumidified while passing through the first region 210, and a control unit 10 configured to control the dehumidifying rotor 200 and the cooling units 150 and 160.

The first air flow paths 111, 113, and 115 include the first inlet flow paths 111 and 113 which communicate with one side of the indoor area and through which indoor air RA is introduced, and the first outlet flow path 115 which communicates with the outer side of the indoor area and discharges the air introduced through the first inlet flow paths 111 and 113 back to the indoor area.

The first inlet flow paths 111 and 113 connect an inlet side of the first inlet flow path 111 through which indoor air is introduced and an inlet end of the first region 210. Accordingly, the indoor air flows through the first inlet flow paths 111 and 113 and the first region 210.

The first outlet flow path 115 connects an outlet end of the first region 210 and an outlet 115*a* through which air SA passing through the first region 210 is discharged to the indoor area.

An outdoor air inlet 311 and an outdoor air outlet 312 are respectively provided at one end and the other end of the second air flow path 310, and both ends of the second air flow path 310 communicate with the outdoor area so that outdoor air OA is introduced or air EA is discharged to the outdoor area.

The first air flow paths 113 and 115 and the second air flow path 310 are partitioned by a partition 450. The first air flow paths 113 and 115 partitioned by the partition 450 may be provided at an indoor side, and the second air flow path 310 may be provided at an outdoor side.

A third air flow path 410 is connected to the first inlet flow path 113 such that the outdoor air OA is introduced. In a case in which a first flow path blower 130 is operated, outdoor air introduced through the third air flow path 410 is mixed with air flowing through the first inlet flow path 113, and the mixed air flows through the first region 210 and then flows to the first outlet flow path 115.

The first inlet flow paths 111 and 113 are connected to extraction flow paths 112 and 114. The extraction flow paths 112 and 114 include the first extraction flow path 112 through which air introduced into an evaporative cooler 150 flows and the second extraction flow path 114 through which air discharged from the evaporative cooler 150 flows to the second region 220.

The first extraction flow path 112 is branched from the first inlet flow paths 111 and 113 such that extracted air which is some of the air introduced from an indoor area through the first inlet flow path 111 flows to the evaporative cooler 150.

A first damper 120 for opening or closing the flow path is provided on the first inlet flow path 113. When the first damper 120 is closed, all of the air introduced from the indoor area flows to the extraction flow paths 112 and 114, and when the first damper 120 is opened, air introduced from the indoor area is split and flows through the first inlet flow path 113 and the extraction flow paths 112 and 114.

An extraction blower 170 for causing the extracted air to flow is provided on the second extraction flow path 114.

A first flow path blower 130 is provided at a front end of the first region 210 of the dehumidifying rotor 200 on the first air flow paths 111, 113, and 115. The first flow path blower 130 discharges indoor air introduced through the first inlet flow paths 111 and 113 to the other side of the indoor area through the first region 210 and the first outlet flow path 115.

A first heater 140 may be provided between the first flow path blower 130 and the first region 210 of the dehumidifying rotor 200. The first heater 140 may be controlled to be turned on or off according to an indoor temperature or humidity. When an indoor temperature needs to be increased and indoor humidity needs to be increased by evaporating moisture of the first region 210, the first heater 140 is turned on to heat air flowing toward the first region 210. In the first region 210, an amount of evaporated moisture is increased due to the heated air, and thus an adjustment ability of indoor humidity is improved.

The evaporative cooler 150 and the evaporator 160 forming the cooling units 150 and 160 are provided on the first outlet flow path 115.

Heat exchange between extraction air flowing in the extraction flow paths 112 and 114 and air flowing in the first outlet flow path 115 is performed in the evaporative cooler 150. Dry and wet channels 152, 151 isolated from each other are provided in the evaporative cooler 150. The extraction air flows through the wet channel 151, and the wet channel 151 is connected to the extraction flow paths 112 and 114. The air flowing in the first outlet flow path 115 flows through the dry channel 152 connected to the first outlet flow path 115. The evaporative cooler 150 may have a structure in which a plurality of plates are spaced a predetermined distance from each other and stacked, and spaces isolated from each other between the plates alternately form the wet channels 151 and dry channels 152. Accordingly, the dry channels 152 and the wet channels 151 are isolated from each other by the plates, and heat exchange is performed by the plates.

The wet channel 151 includes a moisture supplier 153 for supplying moisture to air flowing in the wet channel 151. The moisture supplier 153 may include a water injection pump for injecting water and a spray nozzle for spraying water supplied by the water injection pump. An amount of water sprayed by an operation of the water injection pump may be adjusted according to an indoor temperature or humidity.

When water is sprayed to extraction air flowing in the wet channel 151, the sprayed water is evaporated to cool the plates surrounding the wet channel 151 and cools air flowing in the dry channel 152.

The evaporator 160 forms a cooling cycle with a condenser 350, a compressor 360, and an expansion valve (not shown). The evaporator 160 is provided on the first outlet flow path 115 and connected to an output end of the expansion valve to evaporate a refrigerant expanded due to a low pressure. Air flowing in the first outlet flow path 115 may be cooled by an endothermic phenomenon during the evaporation.

The compressor 210 is provided on the second air flow path 310 and compresses a refrigerant to have a high temperature and a high pressure. In a case in which the compressor 210 operates, exothermic action occurs, and air flowing in the second air flow path 310 may be heated by the exothermic action.

The condenser 350 is provided in the second air flow path 310 and connected to a refrigerant output end of the compressor 210 to condense a refrigerant compressed at a high temperature and a high pressure. Air flowing in the second air flow path 310 may be heated by an exothermic phenomenon during the condensing process.

The expansion valve is connected to the output end of the condenser 350 to expand a refrigerant.

The present invention includes the cooling cycle, but may also include a heat pump system. In a case in which the heat pump system is used, functions of the evaporator 160 and the condenser 350 are swapped for each other. Accordingly, since the evaporator 160 serves as a heater configured to heat air, air supplied to an indoor area may be heated using the evaporator 160 when heating the indoor area.

The dehumidifying rotor 200 includes an adsorbing material for adsorbing moisture of air in the dehumidifying rotor 200. The dehumidifying rotor 200 is rotated about a shaft provided at a center thereof by a driving unit (not shown). The dehumidifying rotor 200 adsorbs moisture of air flowing through the first region 210 during a dehumidifying and cooling operation, and when part of the adsorbing material to which the moisture is adsorbed is positioned at the second region 220 by the rotation, the part of the adsorbing material is dried and regenerated due to outdoor air flowing through the second region 220. In addition, during a humidifying operation, moisture of air flowing through the second region 220 is adsorbed, and when part of the adsorbing material to which the moisture is adsorbed is positioned at the first region 210 by the rotation, the part of the adsorbing material is dried and regenerated due to air flowing through the first region 210. As described above, the dehumidifying rotor 200 rotates to repeat the moisture adsorbing and regenerating process.

The adsorbing material may use a dehumidifying agent, such as silica gel or zeolite, and have a predetermined pattern such as a honeycomb pattern.

A surface of the adsorbing material may be coated with a desiccant polymer. The desiccant polymer is an electrolyte polymer material and is ionized when in contact with moisture, and when the adsorbing material is in contact with moisture, bacteria is removed from the adsorbing material due to an osmotic pressure phenomenon caused by a difference in ion concentration, and thus an antibacterial effect occurs. In addition, ammonia, hydrogen sulfide, or the like which causes foul odors is adsorbed to the desiccant polymer ionized into polarized molecules, and a deodorizing effect occurs. The coated desiccant polymer may use silica or zeolite.

The control unit 10 may adjust indoor humidity by changing the number of rotations of the dehumidifying rotor 200 according to the indoor humidity. That is, in a case in which an indoor area is dehumidified, an amount of dehumidification of the dehumidifying rotor 200 is increased when the number of rotations of the dehumidifying rotor 200 is increased, and an amount of dehumidification thereof is decreased when the number of rotations of the dehumidifying rotor 200 is decreased, and thus an amount of dehumidification may be adjusted. In addition, in a case in which the indoor area is humidified, an amount of humidification of the dehumidifying rotor 200 is increased when the number of rotations of the dehumidifying rotor 200 is increased, and an amount of humidification is decreased when the number of rotations of the dehumidifying rotor 200 is decreased, and thus an amount of humidification of the indoor area may be adjusted. In this case, as amounts of air blown by the first flow path blower 130, the extraction blower 170, and a second flow path blower 330 may be adjusted together, indoor humidity may reach an optimum state.

The second flow path blower 330 for introducing air OA of one side of the outdoor area and causing the air OA to flow to the other side of the outdoor area is provided on the second air flow path 310. The second flow path blower 330 causes outdoor air introduced through the outdoor air inlet 311 to flow to the other side of the outdoor area through the second air flow path 310, the second region 220, and the outdoor air outlet 312. A blowing direction of the first flow path blower 130 is opposite to that of the second flow path blower 330.

A second heater 340, which is turned on when dehumidifying an indoor area, heats air flowing toward the second region 220, evaporates moisture of the adsorbing material of the second region 220, and regenerates the second region 220, is provided on the second air flow path 310.

The second heater 340 configured to heat outdoor air desired to be delivered by the second flow path blower 330 to increase a drying rate of the dehumidifying rotor 200 so as to suitably regenerate the second region 220 of the dehumidifying rotor 200 further heats the outdoor air preheated while flowing through the compressor 360 and the condenser 350 of a compression type cooling apparatus at a temperature suitable for vaporize moisture of the second region 220. The second heater 340 may include a hot water pipe in which hot water flows, outdoor air is heated due to heat exchange with the hot water pipe, and a function of the first heater 140 is identical to that of the second heater 340.

A second damper 320 for blocking or releasing an air flow is provided at a side of the outdoor air outlet 312 of the second air flow path 310. Air to be delivered by an operation of the extraction blower 170 is introduced into the second air flow path 310 through the second extraction flow path 114, and in a case in which the second damper 320 is opened due to an operation of a dehumidification mode, air is discharged to the outdoor area through the outdoor air outlet 312, and in a case in which the second damper 320 is closed due to an operation of a humidification mode, air is discharged to the outdoor area through the second region 220 and the outdoor air inlet 311. Accordingly, the second damper 320 serves to switch directions of air flows in the second air flow path 310 so that air flows in opposite directions in the dehumidification and humidification modes.

An indoor temperature sensor 11 configured to detect an indoor temperature and a indoor humidity sensor 12 configured to detect indoor humidity may be provided in the air conditioner. The control unit 10 controls an indoor temperature and indoor humidity according to a temperature and humidity detected by the indoor temperature sensor 11 and the indoor humidity sensor 12.

The first heater 140 is provided between the first flow path blower 130 and the first region 210 in the above description, but instead of the first heater 140, a third heater 180 may also be provided at a rear end of the evaporator 160, or the first heater 140 and the third heater 180 may also be provided together. The third heater 180 heats air discharged to an indoor area through the outlet 115*a* to quickly realize a desired indoor temperature when heating an indoor area.

<Dehumidifying and Cooling Operation and Humidity Adjusting Operation>

Hereinafter, a dehumidifying and cooling operation and a humidity adjustment operation performed by the air conditioner of the present invention will be described with reference to FIGS. 3 and 4.

When the air conditioner is operated in a dehumidification and cooling mode, the air conditioner enters the state illustrated in FIG. 3. That is, the first damper 120 and the second damper 320 are opened, the extraction blower 170, the first flow path blower 130, the second flow path blower 330, the second heater 340, the evaporative cooler 150, the evaporator 160, the condenser 350, and the compressor 360 are turned on and operated, and the dehumidifying rotor 200 is rotated. The first heater 140 and the third heater 180 are in off states.

Indoor air is introduced into the first inlet flow paths 111 and 113 by an operation of the first flow path blower 130. In this case, some of the introduced air flows to the wet channel 151 in the evaporative cooler 150 through the first extraction flow path 112 by an operation of the extraction blower 170. Water is sprayed to the wet channel 151 by the moisture supplier 153, the water absorbs heat while the sprayed water is vaporized to cool the plate which is a border between the wet channel 151 and the dry channel 152, and the air flowing in the dry channel 152 is cooled by the cooling of the plate.

The indoor air passing through the first inlet flow paths 111 and 113 flows to the first region 210 of the dehumidifying rotor 200. In this case, outdoor air is introduced through the third air flow path 410 and compensates for the indoor air discharged to the outdoor area through the second extraction flow path 114. Moisture of the air passing through the first region 210 is adsorbed to the adsorbing material so that the air enters a dry state. The adsorbing material which adsorbs moisture in the first region 210 is moved to the second region 220 by the rotation.

The air passing through the first region 210 is cooled by heat exchanging with the wet channel 151 while passing through the dry channel 152 in the evaporative cooler 150, and the cooled air flows to the evaporator 160.

The evaporator 160 cools the air passing through the evaporative cooler 150 again by vaporizing a refrigerant, and low temperature dry air passing through the evaporator 160 is discharged to an indoor area. Through the above-described process, indoor cooling and humidity is adjusted.

At this point, the second flow path blower 330 is operated such that the outdoor air is introduced through the outdoor air inlet 311 and flows in the second air flow path 310. The air in the second air flow path 310 is preheated for a first time by absorbing heat generated by the compressor 360 while passing through the compressor 360 and preheated for a second time by absorbing heat generated by the condenser 350 while passing through the condenser 350. The air flowing through the condenser 350 is heated by the second heater 340, and flows through the second region 220 of the dehumidifying rotor 200, and since the adsorbing material which adsorbs moisture in the first region 210 is positioned in the second region 220, the air heated by the second heater 340 dries out the moisture of the adsorbing material of the second region 220 to regenerate the dehumidifying rotor 200. As the regenerated adsorbing material is rotated again and positioned in the first region 210, dehumidification and regeneration are repeated.

The air passing through the second region 220 is discharged to the outdoor area through the outdoor air outlet 312 in which the second damper 320 is opened. In this case, the wet extraction air passing through the wet channel 151 of the evaporative cooler 150 is also discharged to the outdoor area through the second extraction flow path 114 and the outdoor air outlet 312.

In this case, an indoor temperature and humidity are measured by the temperature sensor and the humidity sensor, respectively, and measured indoor temperature, and humidity information are transmitted to the control unit 10.

The control unit 10 controls the above-described units to be turned on or off such that the indoor temperature and humidity become a predetermined temperature and predetermined humidity, respectively.

In this case, the humidity may be controlled by adjusting the number of rotations of the dehumidifying rotor 200 and turning the second heater 340 on or off.

That is, in a case in which indoor humidity needs to be increased, the number of rotations of the dehumidifying rotor 200 may be increased to control the indoor humidity, and in a case in which the indoor humidity needs to be decreased, the number of rotations of the dehumidifying rotor 200 may be decreased to control the indoor humidity. In addition, when the second heater 340 is turned on, since an amount of moisture that is dried out of the adsorbing material of the second region 220 is increased, an amount of dehumidification is increased, and thus the indoor humidity may be decreased, and when the second heater 340 is turned off, since the amount of moisture dried out of the adsorbing material of the second region 220 is decreased, the amount of dehumidification is decreased, and thus the indoor humidity may be increased.

In addition, a temperature may be controlled by adjusting an amount of air blown by the extraction blower 170 and an amount of water injected by the moisture supplier 153 and turning the compressor 360 on or off.

That is, in a case in which an indoor temperature needs to be decreased, an amount of air blown by the extraction blower 170 and an amount of water injected by the moisture supplier 153 may be increased to decrease an air temperature of the dry channel 152 by increasing an amount of vapor in the wet channel 151, and the compressor 360 may be turned on to cool air in the evaporator 160. In a case in which an indoor temperature needs to be increased, the air conditioner is operated in a manner opposite the above manner.

Meanwhile, in a case in which an indoor area is divided into a plurality of rooms, control of a temperature and humidity of each of the rooms is performed by changing and adjusting an amount of air of an indoor unit (not shown) connected to a side of the outlet 115*a* of the first outlet flow path 115 and installed in each of the rooms.

Although humidification and cooling of an indoor area are performed through the above-described processes, in a case in which the humidification and cooling of the indoor area are performed for a long time, the indoor humidity may be excessively lowered. In this case, the indoor area needs to be humidified to quickly adjust the indoor humidity.

A control process when humidifying an indoor area will be described with reference to FIG. 4.

When the air conditioner is operated in a humidification mode, the air conditioner enters the state illustrated in FIG. 4. That is, the first damper 120 is opened, and the second damper 320 is closed. The extraction blower 170, the first flow path blower 130, the first heater 140, and the evaporative cooler 150 are turned on and operated, and the dehumidifying rotor 200 is rotated. The second flow path blower 330, the second heater 340, the evaporator 160, the condenser 350, the compressor 360, the third heater 180 are turned off and stopped.

Indoor air is introduced into the first inlet flow paths 111 and 113 by an operation of the first flow path blower 130. In this case, some of the introduced air flows to the wet channel 151 in the evaporative cooler 150 through the first extraction flow path 112 by an operation of the extraction blower 170. Water is sprayed to the wet channel 151 by the moisture supplier 153, and the air moisturized by the spraying of the water flows to the second air flow path 310 through the second extraction flow path 114.

In this case, since the second damper 320 is in a closed state, the wet air passing through the second extraction flow path 114 flows toward the second region 220 of the dehumidifying rotor 200. Moisture of the wet air passing through the second region 220 is adsorbed to the adsorbing material of the second region 220, and the air passing through the second region 220 enters a dry state. The adsorbing material adsorbing the moisture in the second region 220 is moved to the first region 210 by the rotation.

The air which enters the dry state while passing through the second region 220 is discharged to the outdoor area after passing through the second air flow path 310.

The indoor air passing through the first inlet flow paths 111 and 113 by the first flow path blower 130 flows to the first region 210 of the dehumidifying rotor 200 after being heated by the first heater 140.

Since the adsorbing material adsorbing moisture in the second region 220 is rotated and positioned in the first region 210, the air heated by the first heater 140 dries out the moisture of the adsorbing material of the first region 210 to regenerate the dehumidifying rotor 200.

A temperature of the air passing through the first region 210 and containing moisture is decreased while passing through the evaporative cooler 150, and is discharged to an indoor area, and thus indoor humidity is increased.

<Ventilating Operation and Humidity Adjusting Operation>

A control process in which a ventilating and humidifying operation is performed in the air conditioner of the present invention will be described with reference to FIG. 5.

When the air conditioner is operated in a ventilation mode in which indoor air is discharged to the outdoor area and outdoor air is introduced into an indoor area to ventilate the indoor area, the air conditioner enters the state illustrated in FIG. 5.

That is, the first damper 120 and the second damper 320 enter closed states. The extraction blower 170 and the first flow path blower 130 are turned on and operated, and the dehumidifying rotor 200 is rotated. The first heater 140, the evaporative cooler 150, the evaporator 160, the third heater 180, the second flow path blower 330, the second heater 340, the condenser 350, and the compressor 360 are turned off and stopped. Here, the term "off" of the evaporative cooler 150 refers to the stopped operation of the moisture supplier 153.

Indoor air is introduced into the first inlet flow path 111 by an operation of the extraction blower 170. In this case, since the first damper 120 is in a closed state, all of the introduced indoor air sequentially flows through the first extraction flow path 112, the wet channel 151 in the evaporative cooler 150, and the second extraction flow path 114 to flow to the second air flow path 310.

Since the second damper 320 is closed so that the outdoor air outlet 312 is in a blocked state in the second air flow path 310, the air passing through the second extraction flow path 114 is discharged to the outdoor area through the second region 220 of the dehumidifying rotor 200, the second air flow path 310, and the outdoor air inlet 311.

In addition, when the first flow path blower 130 is operated, since the first damper 120 is in a closed state, introduction of the indoor air is blocked, and outdoor air is introduced through the third air flow path 410. The introduced outdoor air flows through the first region 210 of the dehumidifying rotor 200 and is introduced into an indoor area through the first outlet flow path 115, and thus the indoor area is ventilated.

According to the above-described configuration, heat exchange between the indoor air and the outdoor air is performed at the evaporative cooler 150 for a first time, and heat exchange between the indoor air and the outdoor air is performed at the dehumidifying rotor 200 for a second time.

In a summer season or a period between seasons, an indoor temperature measured by an indoor temperature sensor 11 is low, and an outdoor temperature measured by an outdoor temperature sensor 13 is high. When the air conditioner is operated in the ventilation mode under such temperature conditions, heat exchange between outdoor air flowing in the dry channel 152 and indoor air flowing in the wet channel 151 is performed in the evaporative cooler 150, and a temperature of the outdoor air flowing in the first outlet flow path 115 is decreased.

In addition, when the indoor air flows through the second region 220 of the dehumidifying rotor 200, a temperature of the adsorbing material is decreased, and when the adsorbing material in which the temperature thereof has been decreased is positioned in the first region 210 by the rotation, heat of the outdoor air is exchanged while the outdoor air flows through the first region 210, and the outdoor air in which the temperature thereof has been decreased flows to the first outlet flow path 115.

As described above, since the outdoor air, of which heat is exchanged two times in the evaporative cooler 150 and the dehumidifying rotor 200, is introduced into the indoor area, a cooling load may be reduced and a comfortable indoor environment may also be provided.

In a period between seasons or a winter season, an outdoor temperature measured by an outdoor temperature sensor 13 is low, and an indoor temperature measured by an indoor temperature sensor 11 is high. When the air conditioner is operated in the ventilation mode under such temperature conditions, heat exchange is performed two times in the evaporative cooler 150 and the dehumidifying rotor 200, and a temperature of outdoor air introduced into an indoor area is increased through a process identical to the above-described process. Accordingly, a heating load in an indoor area may be reduced, and a comfortable indoor environment may also be provided.

Meanwhile, when humidification is needed due to low indoor humidity in the ventilation mode, a humidifying operation is performed, and operations of the units in this case will be described with reference to FIG. 6.

That is, in a case in which the humidifying operation is performed, all operations of the units are identical to those of the units illustrated in FIG. 5 except for the evaporative cooler 150. The moisture supplier 153 of the evaporative cooler 150 is turned on to supply moisture to air flowing in the wet channel 151 of the evaporative cooler 150 and generates wet air. The moist air is introduced into the second air flow path 310 through the second extraction flow path 114, and moisture is adsorbed to the adsorbing material of the second region 220 while the moist air flows through the second region 220 of the dehumidifying rotor 200. The air dried out due to the moisture thereof being adsorbed to the second region 220 is discharged to the outdoor area through the second air flow path 310.

Since outdoor air is introduced through the third air flow path 410 by an operation of the first flow path blower 130, and the adsorbing material which adsorbs moisture in the second region 220 is positioned in the first region 210, the moist air generated by air being introduced through the third air flow path 410 evaporating the moisture of the adsorbing material while passing through the first region 210 flows to an indoor area through the first outlet flow path 115. Through such a process, indoor ventilation and indoor humidification are simultaneously performed.

In this case, although the first heater 140 may be configured to be in an off state, the first heater 140 may also be configured to be in an on state to perform evaporation in the first region 210 so as to increase an amount of humidification. In addition, when the first heater 140 is turned on, since the outdoor air is heated by the first heater 140 and introduced into the indoor area, the indoor area may be heated in a case in which a temperature is low. In addition, the third heater 180 may also be configured to be turned on in a case in which the indoor area needs to be heated.

<Heating Operation and Humidity Adjusting Operation>

A control process in which a heating and humidifying operation is performed in the air conditioner of the present invention will be described with reference to FIG. 7.

In a case in which a heating operation for heating indoor air and a humidifying operation for adjusting an indoor humidity measured by an indoor humidity sensor 12 are simultaneously performed, operations of all the units are illustrated in FIG. 7.

That is, in a case in which the heating operation is performed, the first damper 120 is opened, and the second damper 320 is a closed. The evaporative cooler 150, the extraction blower 170, the first flow path blower 130, and the first heater 140 are turned on and operated, and the dehumidifying rotor 200 is rotated. In a case in which the third heater 180 is provided in the air conditioner, the third heater 180 may be turned on. The evaporator 160, the second flow path blower 330, the second heater 340, the condenser 350, and the compressor 360 may be turned off and stopped.

Indoor air is introduced into the first inlet flow path 111 by operations of the first flow path blower 130 and the extraction blower 170. Some of the introduced air flows toward the first region 210 of the dehumidifying rotor 200 through the first inlet flow path 113, and the remaining air is introduced into evaporative cooler 150 through the first extraction flow path 112, and flows toward the second region 220 of the dehumidifying rotor 200 through the second extraction flow path 114.

Outdoor air is introduced through the third air flow path 410 by an operation of the first flow path blower 130, the indoor air and the outdoor air are mixed, and the mixed air is heated by the first heater 140 and flows to the first region 210 of the dehumidifying rotor 200.

The indoor air introduced into the wet channel 151 of the evaporative cooler 150 through the first extraction flow path 112 supplies moisture to air flowing in the wet channel 151 when the moisture supplier 153 is turned on, and thus moist air is generated. The moist air is introduced into the second air flow path 310 through the second extraction flow path 114 and flows through the second region 220 of the dehumidifying rotor 200 while the moisture of the moist air is adsorbed to the adsorbing material of the second region 220. The air dried by the moisture being adsorbed to the adsorbing material in the second region 220 is discharged to the outdoor area through the second air flow path 310.

Since some of the indoor air is discharged to the outdoor area through the second air flow path 310 as described above, the outdoor air is introduced into an indoor area through the third air flow path 410 to compensate for an amount of discharged indoor air. Through such a process, compensation for indoor air and ventilation are simultaneously performed.

Since the adsorbing material adsorbing the moisture in the second region 220 is positioned in the first region 210 by the rotation, the air heated by the first heater 140 evaporates the moisture of the adsorbing material while passing through the first region 210 to enter a moist state and is discharged to the indoor area through the first outlet flow path 115. Through such a process, indoor heating and indoor humidifying are simultaneously performed.

In this case, the moisture supplier 153 of the evaporative cooler 150 may also be turned off according to an indoor humidity measured by an indoor humidity sensor 12 to block supply of moisture, or an amount of moisture supplied by the moisture supplier 153 may also be adjusted to adjust humidity.

In the case in which the third heater 180 is provided therein, air passing through the first region 210 is heated just before being introduced into an indoor area, and introduced into an indoor area. In a case in which the air is heated by the first heater 140, the air may lose heat while passing through the evaporative cooler 150 and the evaporator 160, but in a case in which the air is heated by the third heater 180, heat loss may be prevented, and thus heating may be quickly performed.

Meanwhile, in a case in which a heat pump system is provided instead of the cooling system including the evaporator 160, the condenser 350, and the compressor 360, the evaporator 160 acting as a condenser may be substituted by reversely circulating a refrigerant during the heating mode, and thus the evaporator 160 may be used as an auxiliary heat source.

In a case in which the second heater 340 includes the hot water pipe in which hot water flows, freezing damage of the hot water pipe may occur due to freezing of the water remaining in the hot water pipe. In the case of the present invention, since indoor air flows to the second air flow path 310 through the extraction flow path 114 and the second region 220 during the heating mode, and the second heater 340 may be maintained in a room temperature state due to the indoor air flowing in the second air flow path 310, the freezing damage of the hot water pipe may be prevented.

<Dehumidifying Rotor Drying Mode>

A dehumidifying rotor drying mode for drying the dehumidifying rotor 200 in a case in which the dehumidifying rotor 200 is wet will be described with reference to FIGS. 8 and 9.

The dehumidifying rotor 200 may enter a wet state in which moisture supplied by the moisture supplier 153 is adsorbed to dehumidifying rotor 200 or moisture contained in indoor air is adsorbed thereto, and in a case in which the wet state thereof is left alone, contamination by bacterial proliferation may occur. Accordingly, a process for drying the dehumidifying rotor 200 is needed.

As illustrated in FIG. 8, when the air conditioner is operated in the dehumidifying rotor drying mode, the first damper 120 and the second damper 320 are closed, the extraction blower 170 is turned on, indoor air sequentially flows through the first inlet flow path 111, the extraction flow paths 112 and 114, and the second region 220 of the dehumidifying rotor 200, and the second region 220 is dried while the indoor air flows through the second region 220.

When the adsorbing material of the second region 220 is dried, the dehumidifying rotor 200 is rotated, the adsorbing material positioned in the first region 210 is moved to a position of the second region 220, and the second region 220 is dried again while the indoor air flows through the second region 220.

The air passing through the second region 220 is discharged to the outdoor area through the second air flow path 310, when the indoor air is discharged to the outdoor area, since a pressure of an indoor space is decreased, and thus the decrease in the pressure needs to be compensated for. Accordingly, the indoor air is compensated for by turning the first flow path blower 130 on to introduce outdoor air through the third air flow path 410. In this case, when the first heater 140 is turned on, since the outdoor air flows through the first region 210, the dehumidifying rotor 200 may be quickly dried.

As the above-described process is repeated, the first region 210 and the second region 220 of the dehumidifying rotor 200 enter dry states.

While FIG. 8 illustrates a process in which the dehumidifying rotor 200 is dried while the indoor air is discharged to the outdoor area, FIG. 9 illustrates a process in which the dehumidifying rotor 200 is dried by only a flow of outdoor air without discharging indoor air to the outdoor area.

Referring to FIG. 9, the first damper 120 is closed, the second damper 320 is opened, and the extraction blower 170 is turned off, and thus indoor air is not discharged to the outdoor area. In this state, when the second flow path blower 330 is turned on, and the dehumidifying rotor 200 is rotated, outdoor air is supplied to the dehumidifying rotor 200 to dry the second region 220 of the dehumidifying rotor 200. In this case, when the second heater 340 is turned on, the second region 220 may be quickly dried. In addition, since the drying is performed by only the outdoor air in a state in which the indoor air is not discharged to the outdoor area, the first flow path blower 130 does not need to be operated as illustrated in FIG. 8.

As described above, the present invention is not limited to the above-described embodiments, and modified embodiments may be clearly made without departing from the technical spirit in the appended claims of the present invention by those skilled in the art, and the modified embodiments fall within the scope of the present invention.

The invention claimed is:

1. An air conditioner comprising:

a first air flow path (111, 113, 115) provided to communicate with an indoor area;

a second air flow path (310) provided to communicate with an outdoor area;

a dehumidifying rotor (200) including a first region (210) provided along the first air flow path (111, 113, 115), a second region (220) provided along the second air flow path (310), and an adsorbing material which alternately passes through the first region (210) and the second region (220) according to rotation of the dehumidifying rotor (200) and adsorbs moisture in the first region (210) or the second region (220);

a cooling unit (150, 160) configured to cool air from which moisture is removed while passing through the first region (210); and an extraction flow path (112, 114) that is provided to be branched from the first air flow path (111, 113, 115) and connected to the second air flow path (310) such that air introduced from the indoor area flows to second air flow path (310), wherein the cooling unit (150, 160) includes an evaporative cooler (150) in which heat is exchanged between air flowing in the extraction flow path (112, 114) and air flowing in the first air flow path (111, 113, 115).

2. The air conditioner of claim 1, wherein:

a humidification mode configured to humidify an indoor area;

moisture is supplied to air flowing toward the second region (220) by a moisture supplier when the air conditioner is operated in the humidification mode; and the moisture of the air passing through the second region (220) is moved to the first region (210) according to the rotation of the dehumidifying rotor (200) and evaporated in the first region (210), and humidifies the indoor area.

3. The air conditioner of claim 1, wherein:

the first air flow path (111, 113, 115) includes a first inlet flow path (111, 113) configured to connect an inlet through which air in the indoor area is introduced and an inlet end of the first region (210), and a first outlet flow path (115) configured to connect an outlet end of the first region (210) and an outlet through which the air is discharged to the indoor area;

the extraction flow path (112, 114) is branched from the first inlet flow path (111, 113) and connected to the second air flow path (310) such that air introduced from the indoor area flows to the second region (220); and in the evaporative cooler (150), heat is exchanged between air flowing in the extraction flow path (112, 114) and air flowing in the first outlet flow path (115).

4. The air conditioner of claim 3, wherein:

the evaporative cooler (150) includes a wet channel connected to the extraction flow path (112, 114) and a dry channel connected to the first outlet flow path (115); and a moisture supplier configured to supply moisture to air flowing in the wet channel supplies moisture to the air when the air conditioner is operated in a humidification mode for humidifying the indoor area is operated.

5. The air conditioner of claim 4, wherein a first heater (140) which is turned on to heat air flowing toward the first region (210) in a case in which the indoor area is humidified is provided on the first inlet flow path (111, 113).

6. The air conditioner of claim 3, wherein:

an extraction blower (170) configured to cause the extracted air to flow is provided on the extraction flow path (112, 114);

a first flow path blower (130) configured to introduce air at one side of the indoor area and cause the air to flow to the other side of the indoor area is provided on the first air flow path (111, 113, 115);

a second flow path blower (330) configured to introduce air at one side of the outdoor area and cause the air to flow to the other side of the outdoor area is provided on the second air flow path (310); and a direction in which the first flow path blower (130) blows is opposite to a direction in which the second flow path blower (330) blows.

7. The air conditioner of claim 6, wherein:

a second damper (320) configured to open or close an outdoor air outlet (312) through which air passing through the second region (220) is discharged to the outdoor area during a humidification mode is provided on the second air flow path (310); and the second damper (320) is opened during a dehumidification mode and closed during the humidification mode such that a direction in which air flows in the second air flow path (310) is reversed between the modes.

8. The air conditioner of claim 3, wherein a third air flow path (410) through which outdoor air is introduced is connected to the first inlet flow path (113).

9. The air conditioner of claim 8, wherein:

a first damper (120) configured to block or release a flow of air introduced from the indoor area is provided in the first inlet flow path (113);

the first damper (120) is closed to discharge all of the indoor air introduced through the first inlet flow path (111, 113) to the outdoor area through the extraction flow path (112, 114) and the second air flow path (310); and outdoor air is introduced into the indoor area through the third air flow path (410) to ventilate the indoor air.

10. The air conditioner of claim 1, wherein a second heater (340), which is turned on to heat air flowing toward the second region (220) to regenerate the second region (220) when the indoor area is dehumidified, is provided in the second air flow path (310).

11. The air conditioner of claim 10, wherein:

the cooling unit (150, 160) includes an evaporator (160) provided on the first air flow path (115) and configured to cool air passing through the first region (210) and supply the air to the indoor area when the indoor area is dehumidified; and a condenser (350), which heats air of the outdoor area flowing toward the second heater (340) when the indoor area is dehumidified, is provided on the second air flow path (310).

12. The air conditioner of claim 11, wherein a compressor (360) connected to the evaporator (140) and the condenser (350) and configured to compress a heat transfer medium is provided on the second air flow path (310) to heat the outdoor air flowing toward the second heater (340) when the indoor area is dehumidified.

13. The air conditioner of claim 12, wherein the evaporator (160), the condenser (350), and the compressor (360) form a heat pump system to heat air using heat of the evaporator (160) when the indoor area is heated.

14. The air conditioner of claim 1, wherein a surface of the adsorbing material is coated with a desiccant polymer.

15. A method for controlling an air conditioner including a first air flow path (111, 113, 115) provided to communicate with an indoor area, a second air flow path (310) provided to communicate with an outdoor area, and a dehumidifying rotor (200) including a first region (210) provided along the first air flow path (111, 113, 115), a second region (220) provided along the second air flow path (310), an adsorbing material which alternately passes through the first region (210) and the second region (220) according to rotation of the dehumidifying rotor (200) and adsorbs moisture in the first region (210) or the second region (220), an extraction flow path (112, 114) that is provided to be branched from the first air flow path (111, 113, 115) and connected to the second air flow path (310) such that extracted air which is some of the air introduced from the indoor area flows to the second air flow path (310), and a cooling unit (150, 160) that includes an evaporative cooler (150) configured to cool air from which moisture is removed while passing through the first region (210) and in which heat is exchanged between air flowing in the extraction flow path (112, 114) and air flowing in the first air flow path (111, 113, 115), the method comprising:

dehumidifying air passing through the first air flow path (111, 113, 115) while the air flows through the first region (210) and regenerating the second region (220) using outdoor air flowing in the second air flow path (310);

cooling the air passed through the first region (210) using the extracted air in evaporative cooler (150); and controlling the dehumidifying rotor (200) and the cooling unit (150, 160) such that a temperature or humidity of the indoor area is adjusted to a set value thereof.

16. The method of claim 15, wherein:

a second heater (340) is provided on the second air flow path (310); and the second heater (340) is controlled to be turned on or off according to the indoor humidity.

17. The method of claim 15, wherein the number of rotations of the dehumidifying rotor (200) is changed according to the indoor humidity.

18. The method of claim 15, wherein:

the extracted air flows to the second region (220);

the cooling unit (150, 160) includes an evaporative cooler (150) in which heat is exchanged between air flowing in the extraction flow path (112, 114) and air flowing in the first air flow path (115); and a moisture supplier configured to supply moisture to air flowing in the extraction flow path (112, 114) adjusts an amount of moisture supplied to the air according to the indoor temperature or indoor humidity.

19. The method of claim 15, wherein a dehumidification mode or humidification mode is set in the control unit, and an air flow direction of the second air flow path (310) during the dehumidification mode is opposite to that of the second air flow path (310) during the humidification mode.

20. The method of claim 19, wherein:

a second flow path blower (330) configured to cause air to flow is provided in the second air flow path (310);

a second damper (320) configured to open or close a flow path is provided at a side from which air is blown by the second flow path blower (330);

the air flowing in the extraction flow path (112, 114) is caused to flow to the second region (220) by an extraction blower (170); and an air flow direction in the second air flow path (310) is changed by opening or closing the second damper (320) and tuning the second flow path blower (330) and the extraction blower (170) on or off.

21. The method of claim 15, wherein:

a drying mode is configured to dry the dehumidifying rotor (200);

when the air conditioner is operated in the drying mode, a blower (170, 330) is operated such that air flows toward the second region (220); and the air passing through the second region (220) is discharged to the outdoor area.

22. The method of claim 21, wherein:

when the air conditioner is operated in the drying mode, an extraction blower (170) provided on the extraction flow path (114) is operated to supply air of the indoor area to the second region (220) such that the air alternately dries an adsorbing material located in the first region (210) and the second region (220) by rotating the dehumidifying rotor (200) and is discharged to the outdoor area; and an amount of outdoor air equal to an amount of the indoor air discharged to the outdoor area is introduced into the indoor area.

23. The method of claim 21, wherein:

a second flow path blower (330) configured to cause air to flow is provided on the second air flow path (310); and when the air conditioner is operated in the drying mode, the second flow path blower (330) is operated to introduce outdoor air from one end of the second air flow path (310) and supply the outdoor air to the second region (220) such that the outdoor air alternately dries an adsorbing material located in the first region (210) and the second region (220) by rotating the dehumidifying rotor (200) and is discharged to the outdoor area through the other end of the second air flow path (310).

* * * * *